United States Patent [19]

Cannom

[11] 4,270,114

[45] May 26, 1981

[54] ENERGY TRANSMISSION DEVICES

[76] Inventor: David L. Cannom, 276 Cabrillo, #C, Costa Mesa, Calif. 92627

[21] Appl. No.: 137,590

[22] Filed: Apr. 7, 1980

[51] Int. Cl.[3] ..... H01C 8/00

[52] U.S. Cl. ..... 338/224; 338/66; 338/274

[58] Field of Search ..... 338/7, 54, 224, 223, 338/66, 88, 100, 273, 274, 214; 29/610

[56] References Cited

U.S. PATENT DOCUMENTS

| | | | |
|---|---|---|---|
| 439,939 | 11/1890 | Gilbert | 338/224 |
| 493,314 | 3/1893 | Thomson | 338/224 X |
| 919,908 | 4/1909 | Martin | 338/224 X |
| 942,555 | 12/1909 | Hankin | 338/224 |
| 1,397,888 | 11/1921 | Chodrow | 338/224 |
| 1,701,386 | 2/1929 | Mucher | 338/224 X |
| 2,845,515 | 7/1958 | Anderson et al. | 338/273 X |

*Primary Examiner*—C. L. Albritton
*Attorney, Agent, or Firm*—Grover A. Frater

[57] ABSTRACT

A device for inclusion in the ignition current circuit of internal combustion engines in which a body of electrically conductive, irregularly shaped metal granules forms a flowpath in the form of a labyrinth between a pair of end terminals. Compaction pressure and, preferably, inclusion of non-electrically conductive granules is employed to adjust the direct current conductivity of the body of granules.

7 Claims, 6 Drawing Figures

ENERGY TRANSMISSION DEVICES

FIELD OF THE INVENTION

This invention relates to energy transmission devices.

BACKGROUND OF THE INVENTION

This invention improves upon the invention disclosed and described in U.S. Pat. No. 4,188,607 granted Feb. 12, 1980 for Variable Impedance Device. That patent describes a device in which particles of bronze, or of the constituents of bronze, are mixed with a small amount of silica to form an electrically conductive body. When included in the flowpath of ignition current in an internal combustion engine, a gasoline engine, the device exhibits two beneficial effects. It serves to reduce the generation of radio frequency interferring signals, and it increases the fuel utilization efficiency of the engine.

While the patentees advanced possible explanatory theories, they acknowledged that the theoretical basis for those beneficial results was not known. This invention provides devices with even greater benefits in that they offer radio interference suppression as good as, or better than, the bronze devices at lower cost, and in that they provide an even greater increase in fuel utilization efficiency.

SUMMARY OF THE INVENTION

It has been discovered that the inclusion of bronze, or all of the constituents of bronze, is not necessary. Variable impedance and the benefits of radio frequency interference suppression, and increased fuel utilization efficiency result from the combination of a pair of spaced electrodes bridged by a body of irregularly shaped grains of an electrically conductive material compacted in a way and in a degree that results in completion of a continuous electric current between the electrodes while exhibiting direct current impedance greater than what is exhibited by a solid body of the same material and overall size. That impedance may have any value from less than a hundred to several thousands of ohms without major effect on product performance in the areas of interference suppression and efficiency. The requirement is that the grains of conductive material, of metal in practice, be irregular so that the flow path tends to be a labyrinth, and that the degree of compaction be such that the labyrinth is preserved and a direct flowpath not be created.

The preferred way to reach that result is to mix granules of non-electrically conductive material, such as sand, with the conductive grains. The conductive grains, or most of them, are made smaller than the grains of non-conductive material. Inclusion of the larger, non-conductive grains offers two advantages. Sand grains cost much less than metal grains, so the inclusion of sand reduces cost. Further, the inclusion of sand or any larger grained non-conductive material permits the use of greater compaction pressure while maintaining the labyrinth character of the flowpath. Uniformity in product performance is increased when the body of granular material is compressed sufficiently to create a relatively solid body within an enclosing container. Best performance appears to result when the ratio of metal grains to non-metallic grains is from 3 to 1 to 1 to 1.

Each of the metals copper, aluminum, iron, antimony, tin and mixtures of tin and lead is useful in the invention. The best materials are copper, antimony and aluminum.

They exhibit substantially better performance than the other materials, and copper appears to perform better in the sense that performance is not degraded when the proportion of sand grains is increased to equal quantities by volume of copper grains and sand.

The metal grains in successful units have ranged in size from nearly the size of the sand grains to grains of one-tenth or less than the sand grain size. The average size of the metal grains was one-fifth to one-tenth of the volume of the average sand grain volume. Irregularly shaped metal grains is a requirement, but the non-conductive grains may be smooth. Attempts to use metal powders were not successful.

THE DRAWINGS

DETAILED DESCRIPTION

Figure 1:
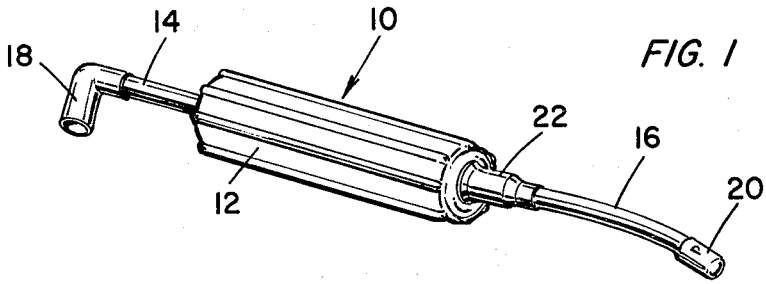
FIG. 1 is an isometric view of an energy transmission device which embodies the invention.

A completed electrical energy transmission device according to the invention is illustrated in FIG. 1. The device is designated 10, and it is formed of a body 12 and high tension conductors 14 and 16 which extend from respectively associated ends of the generally cylindrical body 12. The high tension wire 14 ends in a terminal connector 18, and the high tension wire 16 ends in an end connector 20. The member 22 is a boot that surrounds and protects a connection between high tension wire 16 and the interior of the device.

Figure 2:
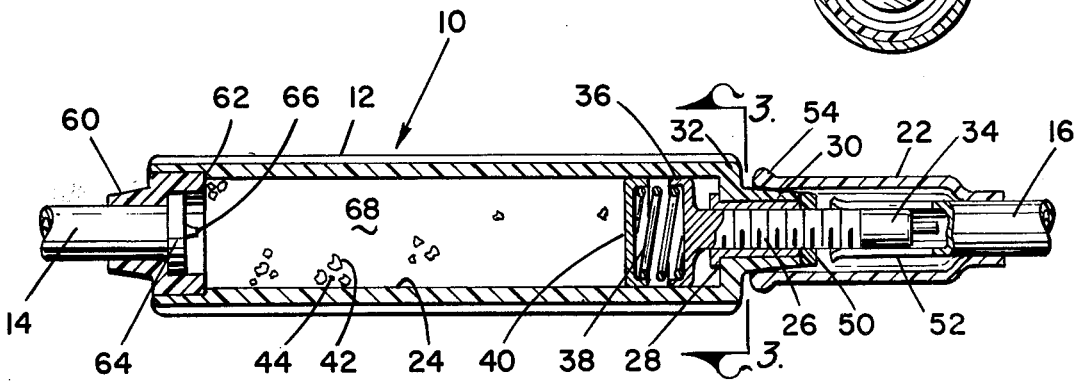
FIG. 2 is a cross-sectional view of the device of FIG. 1 taken on a plane which extends through its longitudinal central axis, the electrical leads being shown fragmented.
Figure 6:
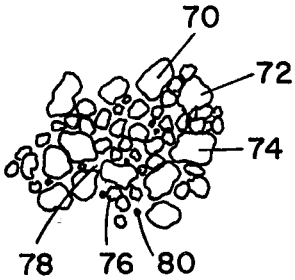
FIG. 6 is a schematic drawing of a portion of a body of granular material that is employed in the invention.
Figure 3:
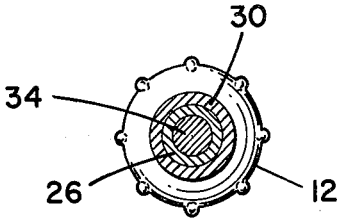
FIG. 3 is a cross-sectional view taken on line 3—3 of FIG. 2.

That connector, and the interior of the energy transfer device, are shown in FIG. 2 which is a cross-sectional view taken on a mid-plane through the device 10 and its end connectors. Only a representative few of the granules are depicted in FIG. 2 to preserve the clarity of the representation of the remaining structure. What the granular substance looks like is shown in FIG. 6.

In this embodiment, the body 12 is formed by a cylindrical cup made of an electrically insulating plastic material. The exterior surface is formed with ribs whose primary purpose is aesthetic. The inner wall 24 of the cup is smooth to form a smooth, cylindrical bore. The bottom wall of the cup, at the right in FIG. 2, is formed with a central opening. A metal sleeve 26 is molded into that opening. The inner end of that sleeve terminates in an outwardly extending flange 28 which rests on the inner bottom wall of the cup. The sleeve extends beyond the bottom of the cup in substantial degree, and is surrounded by an outer plastic sleeve 30 which, in this embodiment, is integrally formed with the bottom wall 32 of the cup.

The sleeve 26 is internally threaded, and its threads engage the external threads of a metal rod 34 whose inner end 36 is disposed inside of the body 12. The forward end 36 has the shape of a shallow, cylindrical cup. Its outer diameter is only slightly less than the inner diameter of the cup-shaped body 12. The cup 36 is shallow and serves as a spring gland for a compression spring 38 whose forward end engages a second metallic cup 40. Cup 40 is cylindrical. It has an outside diameter nearly equal to the inside diameter of body 12. The cup 40 opens toward the cup 36 and the spring 38. In FIG. 2, the function of the spring is to force the cup 40 to the left toward the left end of the unit. The function of cup 40 is to bear upon and compress the granules that are contained in the cup. For the purpose of identification, several of those granules have been identified with reference numerals. Thus, the reference numeral 42 refers to a sand grain, whereas the reference numeral 44 designates one of the metal grains in the body of granular material.

The degree of compaction of the body of granules can be adjusted by rotating the threaded rod 34 to adjust the position of the cup 36 within the body 12. Adjustment having been made, further unwanted adjustment is prevented by tightening the nut 50 down on the threaded rod against the sleeve 26. The high tension wire 16 is connected to a metallic connector sleeve 52. That sleeve has its walls slit lengthwise so that it can be forced over the end of rod 34 and make electrical connection with it. The boot 22 of insulating material is forced along the high tension wire 16 after the position of the rod has been adjusted and fixed with nut 50, and after the sleeve 52 has been attached to the end of the rod 34. The boot is made to slide along the tension wire 16 until its forward end 54 engages the plastic sleeve 30.

At the other end of the unit, the left end in FIG. 2, the cup of the body 12 is sealed closed with an end fitting 60. The fitting is cylindrical. Over a portion of its length it has an outside diameter that fits snugly into the end of the cup where the inside diameter is enlarged slightly to form a shoulder 62 against which the end fitting 60 is brought to bear. The cup 12 and the fitting 60 are welded together so that the fitting is positioned permanently in the cup 12, as shown.

The fitting 60 has a central opening in which an end of high tension wire 14 is received. The inner conductor of that high tension wire extends through an opening in the metal disc 64. The connection is made mechanically secure by soldering the inner connector 66 to the disc 64. The latter rests in an enlarged cylindrical recess in the forward face of the member 60.

The disc 64 serves as one electrode, and the combination of cup 40, spring 38, cup 36, and rod 34 serves as the other terminal of the device. Those two terminals are bridged by the body of granular material that is disposed in the cavity 68 within the housing.

As best shown in FIG. 6, that body of granular material, in the preferred embodiment, comprises a combination of irregularly shaped metal grains and sand grains. It is not material whether the sand grains be smooth or irregular. However, most sand grains have relatively smooth surfaces, and sand grains of that kind have been shown in FIG. 6. The numerals 70, 72 and 74 designate representative ones of those sand grains. They are shown to exceed the metal grains in size. Representative metal grains are designated 76, 78 and 80. They are shown to vary greatly in size from a size that approaches the size of the sand grains to a size that is less than one-tenth the size of most of the sand grains. In this preferred embodiment, the average size of the metallic grains is about one-fifth to onetenth of the size of the sand grains. While the metal grains and the sand grains are uniformly mixed, there is no need for absolute uniformity, and the ratio of the particle sizes may vary greatly from place to place in the body of granular material.

There is not critical path length requirement except that the path length should be sufficiently long so that the desired ratio of grain sizes is substantially achieved. The requirement is that the ignition current path form a labyrinth. The irregular shape of the conductive granules results in inner granular contact at small areas, and the inclusion of the larger grains of non-conductive material ensure that the labyrinth flowpath is maintained over a relatively wide degree of granular body compaction. The invention can be practiced using only irregular grains of metallic material and without the inclusion of non-metallic grains. Thus, for example, the invention can be practiced using only irregularly shaped grains of copper material. In that case, the degree of compaction must be limited. Excessive compaction will increase the area of inter-grain contact so that the device tends to become an electrical conductor whose resistance is no greater than would be exhibited by a solid body of copper.

The ignition current varies in magnitude so that the resultant current can be described as a unidirectional component on which is superimposed alternating variations that vary widely in frequency. The labyrinth path is different for currents of different frequencies. The potential gradient that applies to unidirectional component at conductive areas between grains is different for the unidirectional component of the current than it is for the alternating components of that current.

While it is not essential that the non-conductive grains comprise sand, sand is the preferred material because it is inexpensive. The ratio of sand grains may be varied from equal quantities by volume of metal grains of sand to no sand at all. However, long term stability appears to require a substantial degree of compaction so that in practice about twenty-five percent of non-metallic grains is required when those grains are substantially larger in size than the metallic grains. Thus, in practice, the proportion of sand may be varied from about one part of sand to four parts of metal grains, to the proportion one part of sand to one part of metal grains.

The invention provides two advantages. It diminishes the radio frequency interference that is generated by the flow of ignition currents and, for a reason that is not understood, it increases the efficiency of fuel utilization. The latter is more easily measured so that it is easier to describe the invention and its limits in terms of efficiency improvement. The results of the invention are substantially better when the metal grains are formed of copper or aluminum, or both, than it is when the metal grains are formed of iron or steel or antimony. All of those materials will work and will provide beneficial results. Not all metals have been tested, but among those tested, aluminum and copper are preferred, and copper has provided better results than has aluminum.

The DC resistance of devices that operate successfully varies greatly. Thus, a device in which the degree of compaction is such that a resistance to the flow of unidirectional current of only several hundered ohms appears to work just as well as a device which exhibits DC resistance of two hundred thousand ohms.

It is now preferred to employ a means for maintaining compaction pressure on the body of granules, and the best means thus far devised for accomplishing that is to include a spring structure within the body of the unit by which to urge the conductive plate against the body of granules. That construction is shown in FIG. 2 together with a means for adjusting the initial spring tension.

Figure 4:
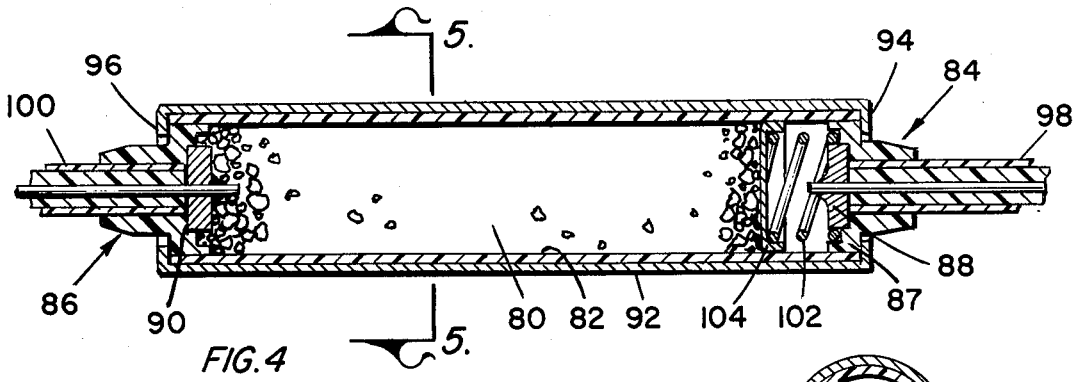
FIG. 4 is a cross-sectional view of an alternative embodiment of the invention taken on a plane that extends through its longitudinal axis, only fragments of the electrical leads being shown.
Figure 5:
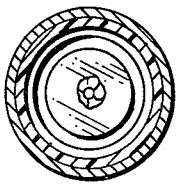
FIG. 5 is a cross-sectional view of the device of FIG. 4 taken on line 5—5 of FIG. 4.

An alternate form of the invention that includes a means for maintaining the body of granules compacted, but without the pressure adjustment, is shown in FIG. 4.

In FIG. 4, the body of granules 80 is composed of sand and metal grains intermixed as indicated in FIG. 6. Those grains are housed in a sleeve 82 of electrically non-conducting material. The sleeve, or tube, 82 is closed at its end by a cup-shaped end fitting 84 at the right and 86 at the left. These two end members are similarly shaped. Each has a cupped end which fits into the end of the tube 82. In the case of fitting 84, that cup end is identified with the reference numeral 87. It is cupped because it is formed with recesses having different diameters. The inner recess accommodates a metal disc 88 in the case of fitting 84, and 90 in the case of fitting 86.

The cupped end of the fitting forms an outwardly extending flange at the end of an otherwise generally cylindrical member. The fittings and the insulating tube 82 are held together by an outer metal sleeve 92 the ends of which are rolled over inwardly against the ends of the insulating tube and against the flange. The "rolled over" portion of the metal sheath is designated 94 at the right in FIG. 4, and at the left it is designated 96. A high tension wire 98 extends into the central opening of the connector 84. The insulation of that high tension wire abuts the face of disc 88, and the center conductor extends through a central opening in the disc to the opposite side where it is soldered to the disc. In a similar construction at the opposite end of the unit, high tension wire 100 extends through the central opening of the fitting 86. The insulation of that wire abuts the outer face of the disc 90, but the center conductor of the high tension wire extends through an opening in the disc and is soldered to the forward face of the disc.

Returning to the right side, the outer recess of the cup 87 of fitting 84 serves as a spring gland for a compression spring 102 which bears against a cup 104. Spring 102 and the cup 104 are similar to the spring 38 and cup 40 in FIG. 2. The outer diameter of cup 104 makes a sliding fit with the inner diameter of the insulating tube 82. During manufacture, the quantity of granular material 80 that is placed in the tube is sufficient to cause a compression of spring 102 in a predetermined degree when the ends of the sheath 92 are spun over to seal the unit closed.

The metal granules in the case of FIG. 2 include both aluminum and copper granules. In the unit of FIG. 4, only copper granules are employed. In the unit of FIG. 2, the sand grains comprise one-fourth of the total volume of the body of granular material. In the case of FIG. 4, the composition of that granular material is one-half copper granules and one-half sand.

It has been suggested that the metal granules may release electrons in the manner of oxygen ionizing "air freshness" and that those electrons ionize constituents of the air within the body of granular material. Transfer of such electrons to other grains or to different regions of the same grains would result in the formation of current paths, and the generation of magnetic field variations, that are substantially different than would occur in solid conductors. It is not known whether ionized oxygen generation has any relation to what occurs in the invention. However, such a theory and the fact that copper, aluminum, and the other metals differ in their valences, might explain why some metals perform better in the invention than others perform.

It is felt that those valence electrons made available as the current passes through the labyrinth of granules were carried by the high tension current across the spark plug gap where they joined oxygen atoms, or oxygen ions, which are ions because they have lost electrons in some condition such as smog, if so, or other conditions which might strip electrons of oxygen atoms. Oxygen atoms which have lost electrons would not be healthy atoms. Only when they are able to regain their full complement of electrons can they perform their jobs efficiently. In this case, they form a more complete combustion, and therefore effect a greater mileage for gasoline burned.

The term "irregularly shaped granules" is used herein to mean granules whose shape makes it impossible, or at least difficult, to compact to a form in which they exhibit electrical conductivity approaching the conductivity of solid and stranded electrical conductors. Irregular shape results when a granule is multisided and the sides have different areas, or are not all parallel or perpendicular. Irregular shape results when the granules have different size and cannot be compacted to near solid form for that reason. Thus, even spherical grains fall within the definition, but only if they differ in size so that compaction cannot defeat the requirement that the current flowpath be a labyrinth.

Although I have shown and described certain specific embodiments of my invention, I am fully aware that many modifications thereof are possible. My invention, therefore, is not to be restricted except insofar as is necessitated by the prior art.

I claim:

1. An energy transmission device comprising a pair of electrodes electrically interconnected by a body of irregularly shaped granules of a metal, and enclosure means for retaining said body of granules compressed sufficiently to complete an electrical path between said electrodes the direct current impedance of which exceeds the impedance exhibited by a solid body of said metal which occupies an equal volume;

said granules of metal comprising at least one-half by volume of copper.

2. The invention defined in claim 1 in which said body of granules comprises at least one-third by volume of a non-electrically conductive material.

3. The invention defined in claim 2 in which said non-electrically conductive material comprises mostly silica sand.

4. The invention defined in claim 2 which further comprises means in the form of a resilient element for maintaining said body of granules in compression.

5. The invention defined in claim 3 which further comprises means in the form of a resilient element for maintaining said body of granules in compression.

6. An energy transmission device comprising a pair electrodes electrically interconnected enclosure means for retaining said body of granules compressed sufficiently to complete an electrical path between said electrodes the direct current impedance of which exceeds the impedance exhibited by a solid body of said metal which occupies an equal volume;

said granules of metal comprising at least one-half by volume of one of aluminum and antimony.

7. The invention defined in claim 6 in which said non-electrically conductive material comprises mostly sand.

* * * * *